US009640058B1

(12) United States Patent
Bollman et al.

(10) Patent No.: US 9,640,058 B1
(45) Date of Patent: May 2, 2017

(54) SWIMMING POOL MONITOR

(71) Applicants: Jimmy Bollman, Oklahoma City, OK (US); Malorie Faith Travis, Edmond, OK (US); Courtney Alice Robinson, Edmond, OK (US); Jonathan Frederick Kitzrow, Oklahoma City, OK (US); Michael F Smith, Piedmont, OK (US)

(72) Inventors: Jimmy Bollman, Oklahoma City, OK (US); Malorie Faith Travis, Edmond, OK (US); Courtney Alice Robinson, Edmond, OK (US); Jonathan Frederick Kitzrow, Oklahoma City, OK (US); Michael F Smith, Piedmont, OK (US)

( * ) Notice: Subject to any disclaimer, the term of this patent is extended or adjusted under 35 U.S.C. 154(b) by 0 days.

(21) Appl. No.: 14/999,463

(22) Filed: May 10, 2016

(51) Int. Cl.
*G08B 1/08* (2006.01)
*G08B 21/08* (2006.01)

(52) U.S. Cl.
CPC ..... *G08B 21/082* (2013.01)

(58) Field of Classification Search
None
See application file for complete search history.

(56) References Cited

U.S. PATENT DOCUMENTS

| | | | | |
|---|---|---|---|---|
| 3,683,353 | A * | 8/1972 | Miller | G08B 21/084 200/61.51 |
| 3,778,804 | A | 12/1973 | Adair | |
| 3,953,843 | A | 4/1976 | Codina | |
| 4,510,487 | A | 4/1985 | Wolfe | |
| 4,540,976 | A * | 9/1985 | Wegrzyn | G08B 21/084 200/84 R |
| 4,571,579 | A * | 2/1986 | Woolley | G08B 21/082 340/566 |
| 4,644,328 | A * | 2/1987 | Szymansky | G08B 21/084 116/110 |
| 5,043,705 | A | 8/1991 | Rooz | |
| 5,049,859 | A | 9/1991 | Arnell | |
| 5,517,174 | A | 5/1996 | Barrows | |
| 6,133,838 | A | 10/2000 | Meniere | |
| 6,157,303 | A * | 12/2000 | Bodie | G08B 21/088 340/539.1 |
| 7,330,123 | B1 | 2/2008 | Grahn | |
| 2005/0035866 | A1 * | 2/2005 | Hatherell | G08B 21/084 340/573.6 |
| 2008/0106422 | A1 | 5/2008 | Sparks | |
| 2016/0155314 | A1 * | 6/2016 | Snyder | G08B 21/084 340/573.6 |

* cited by examiner

*Primary Examiner* — Brent Swarthout
(74) *Attorney, Agent, or Firm* — Randal D. Homburg

(57) ABSTRACT

A swimming pool monitor detects the presence of a person in a pool by measuring minute changes in current within the pool water upon a person making entry into the pool and also detects the motion of the water waves made by the entry of a person, pet or object into the pool, the monitor relaying the presence alert to a local relay device and onto the owner's chosen alert point.

7 Claims, 4 Drawing Sheets

SWIMMING POOL MONITOR

CROSS REFERENCE TO RELATED APPLICATIONS

None.

I. BACKGROUND OF THE INVENTION

1. Field of Invention

A swimming pool monitor detects the presence of a person in a pool by measuring minute changes in current within the pool water upon a person making entry into the pool and also detects the motion of the water waves made by the entry of a person, pet or object into the pool, the monitor relaying the presence alert to a local relay device and onto the owner's chosen alert point.

2. Description of Prior Art

A preliminary review of prior art patents was conducted by the applicant which reveal prior art patents in a similar field or having similar use. However, the prior art inventions do not disclose the same or similar elements as the present swimming pool monitor, nor do they present the material components in a manner contemplated or anticipated in the prior art.

Multiple solutions have been presented in prior art to detect the presence of a person in a swimming pool and also to monitor a swimmer's activity in order to prevent accidental drowning. In U.S. Pat. No. 3,778,804 to Adair, a stationary system is provided on an above ground pool which provides an alarm which activates when an air-filled hose detects a change in water level. Codina discloses a monitor that detects wave activity to trigger an alarm in U.S. Pat. No. 3,953,813. A device measuring electrical continuity when a wave is detected in a pool is disclosed in U.S. Pat. No. 4,510,487 to Wolfe. In U.S. Pat. No. 5,043,705 to Rooz, a monitor device detects inactivity of a swimmer using a sonar detector located at the bottom of a swimming pool to detect a motionless body within the pool. A sonar transmitter attached to a swimmer is disclosed in U.S. Pat. No. 5,049,859 to Arnell. A water alarm and method provide a hollow tube containing a floatation element is used to detect a motion or displacement of water in a swimming pool in U.S. Pat. No. 5,517,174 to Barrows.

More recently, several patents have evolved using wireless communication technologies which detect various changes in the swimming pool. In U.S. Pat. No. 6,133,858 to Meniere, a plurality of sensing devices are included in the pool lining structures, the sensing devices using electrical deviation and imaging technology to monitor the swimming pool, the monitoring devices providing electrical signals to produce a digitized image of whatever body is present within the pool water. A sonar based drowning monitor is disclosed in U.S. Pat. No. 7,330,123 to Grahn, which immediately detects entry using timeliness prioritization by means of sonar, as opposed to the use of voltage deviation and wave activity, as in the present swimming pool monitor. A swimming pool light contains a system for monitoring the swimming pool through the inclusion of a seismic sensor and an optical sensor relying heavily on data processing to detect emersion events occurring within the swimming pool within which it is installed in U.S. Patent Application No. 2008/0106422 to Sparks.

The above prior art patents are distinguished from the present invention because they do not disclose a free-floating wave motion sensing device combined with a minute voltage deviation detection system to measure the presence of a body entering the swimming pool water and providing an instant audible alert and wireless relay to a remote monitor of the owner using the same components, structures and products.

II. SUMMARY OF THE INVENTION

On the average each year, at least 350 children under the age of 5 years drown in swimming pools with a majority of those drowning occurring in residential swimming pools. Over 75% of those home drowning had been missing for less than 5 minutes when they were found dead in the pool. Seventy percent of those were not expected to be at or near the pool at the time of their drowning. Drowning is the second leading cause of accidental injury-related death among children ages 1-14. All of these statistics are based upon data gained since all the prior art patents were published or issued. Thus, there is a continued problem that has previously not been resolved. These shocking and tragic statistics bear out a continued need which is previously been unresolved and to which the present invention is dedicated.

It is unrealistic and possibly arrogant to believe that any single invention or improvement to the field of pool monitoring can prevent all of the unresolved senseless deaths of children in a residential pool, but this' invention provides new technology and a new system for the detection of a person in a swimming pool which attempts to provide instant presence and alert to a pool owner in an attempt to locate and recover as many persons who are potential drowning victim before it is too late to save them.

III. DESCRIPTION OF THE DRAWINGS

The following drawings are submitted with this utility patent application.

IV. DESCRIPTION OF THE PREFERRED EMBODIMENT

Figure 1:
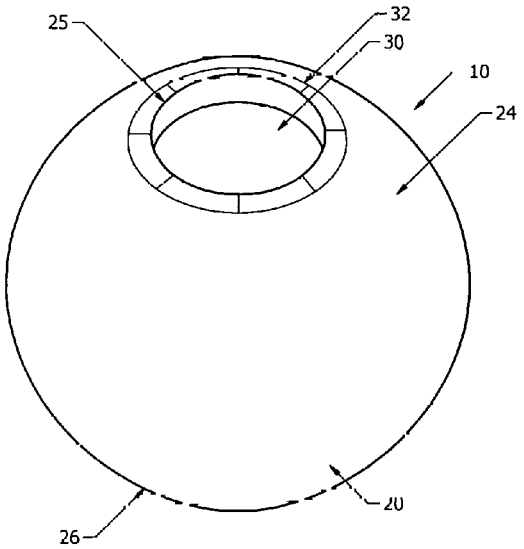
FIG. 1 is a top perspective view of the swimming pool monitor showing the upper portion of the casing and the water-proof lid.
Figure 2:
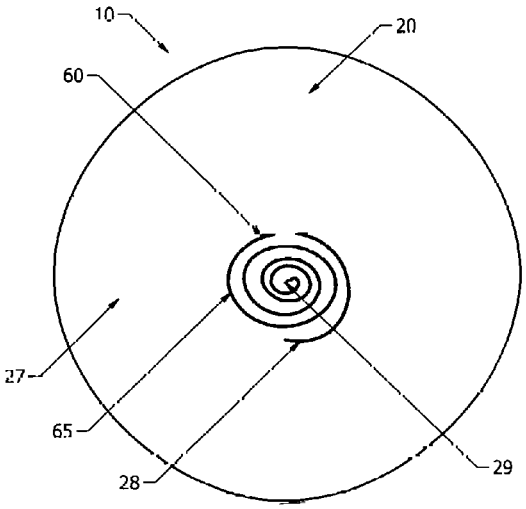
FIG. 2 is a lower end view of the swimming pool monitor showing the lower portion with the electrode located within the electrode groove.
Figure 3:
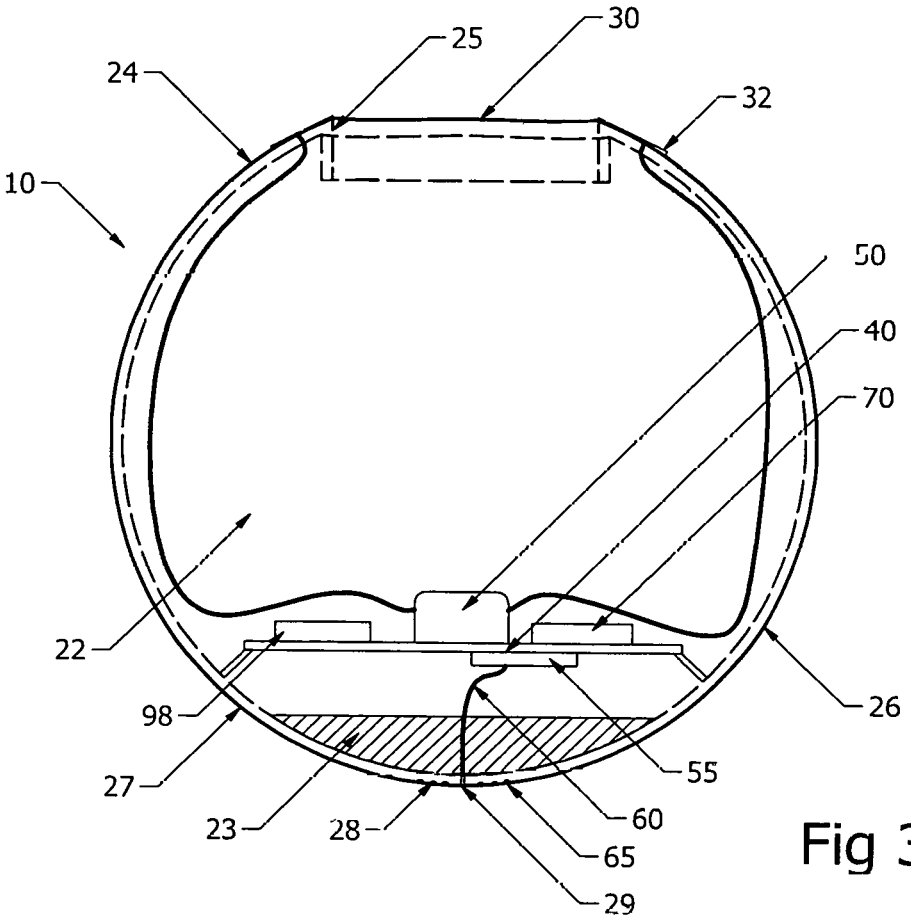
FIG. 3 is a side cross sectional view of the swimming pool monitor with the internal circuitry within the internal cavity.
Figure 4:
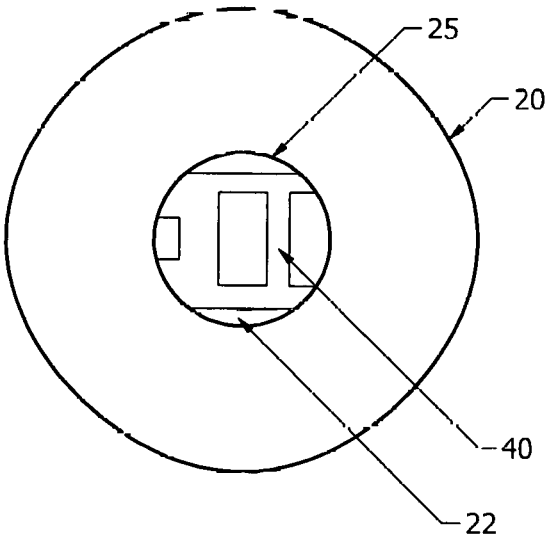
FIG. 4 is a top view of the swimming pool monitor with the lid removed.

A free-floating swimming pool monitor 10, primarily for use in residential swimming pools A to monitor the presence of a person in the swimming pool A when unattended, shown in FIGS. 1-6 of the drawings, provides a casing 20 made of a buoyant and water-proof material, shown in the drawings as a sphere, the casing 20 defining an inner cavity 22, an upper portion 24 having an access opening 25 with a removable water-proof lid 30, and a lower portion 26 with a lower surface 27 defining an electrode groove 28 and an electrode port 29. The inner cavity 22 contains the electronic circuitry 40, FIGS. 3 and 4, and power supply 50 to enable the swimming pool monitor 10 to sense and detect the presence of a person in the swimming pool A in two manners—by motion and by microelectronic deviations measured by the electronic circuitry 40 and relayed to at least one alarm. The shape of the casing 20 is not specific, but it must possess the shape required to float with the upper portion 24 above the water within the swimming pool and the lower portion 26 below the water and also to contain the electronic circuitry 40 and other defined components.

Figure 5:
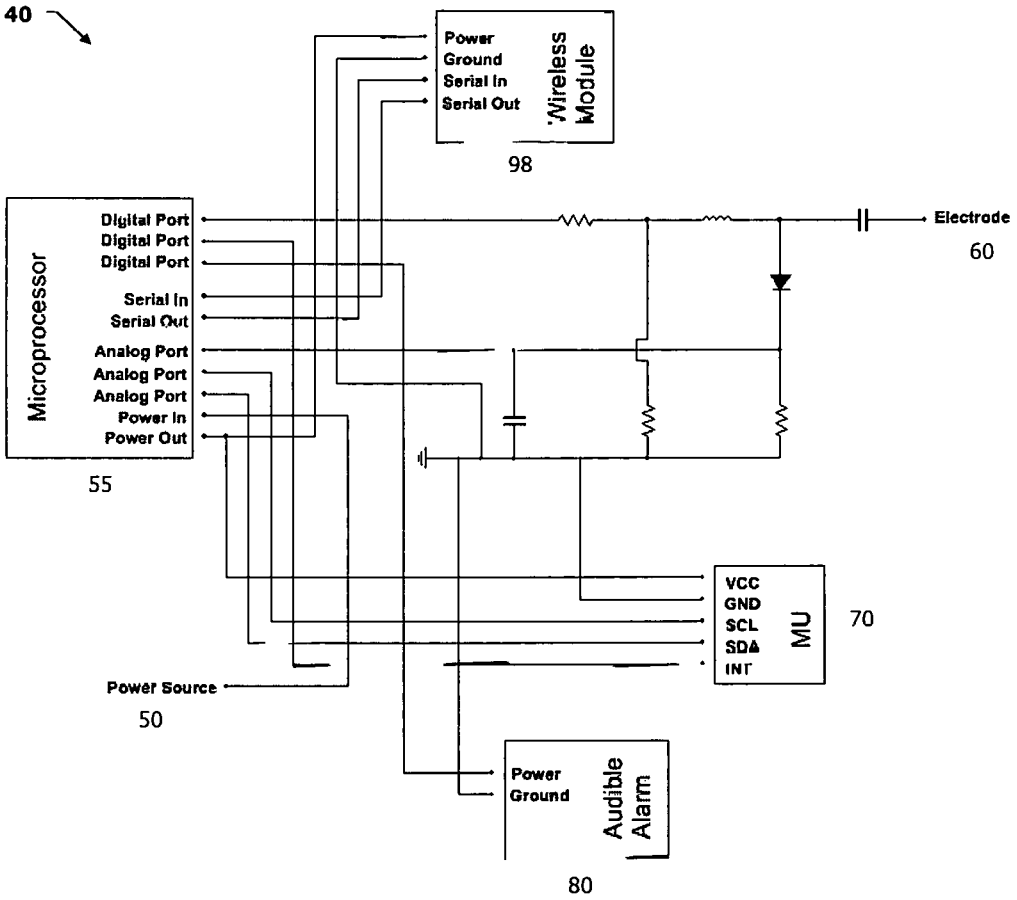
FIG. 5 is a circuit diagram of the internal circuitry of the swimming pool monitor.

The electronic circuitry 40, FIG. 5, comprises a microprocessor 55, preferably an Arduino, attaching an electrode 60, the noted low voltage power supply 50, preferably a rechargeable 9 volt battery, an Inertial Measurement Unit (IMU) 70, and a local alarm 80. Low voltage is defined herein as a power supply of less than 27 volts. Additionally, the electronic circuitry 40 may include a wireless transmitter 98 which provides a wireless signal to a secondary alert components 100 or alarm system. The electrode 60 includes an outer portion 65 which penetrates the casing 20, through the electrode port 29 and into the electrode groove 28 on the lower surface 27 of the casing 20, FIG. 2. The electrode port 29 should be sealed around the electrode 60 to prevent water seepage into the casing 20. It is also recommended using an epoxy cement to maintain the outer portion 65 of the electrode 60 within the electrode groove 28 on the lower surface 27 of the casing 20. This electrode 60 allows the microprocessor 55 to record the voltage of the water over a range of alternating current frequencies and further graphed with respect to frequency at a very minute deviation of current. These measured frequencies are then analyzed by the microprocessor 55 to determine whether a grounded body is making contact with the water and pool surfaces, and whether or not the body is more likely a human or some other conductive material. This operation is performed in a constantly repeating loop in microseconds.

The IMU 70 is supplied as an accelerometer or gyroscope sensor, which records and processes information related to the motion of the free-floating swimming pool monitor 10 in water. It is programmed with the microprocessor 55 to determine turbulence in the wave activity to separate wind movement from a disruptive entry into the water. This distinction is drawn due to the difference in condition of the wave movement, wherein most generally, wind activity causes a gradual change in wave activity that is sustained for a period of time, and abrupt entry causing a more abrupt and less sustained wave activity. This detection of wave movement is a secondary purpose, and is provided in addition to the electrode 60 to measure wave movement where there is not enough voltage deviation to cause the primary sensing of a person entering the water or failing to make contact with a pool surface and become grounded.

A copy of the general wiring diagram for the electronic components 40 in shown in FIG. 5, and basically include the microprocessor 55, resistors, a coil or inductor, diodes, capacitors, wire, a solderable beadboard, an audible emitting means for producing an audible sound, the low voltage power supply 50, the IMU 70 (accelerometer or gyroscope sensor), and the optional wireless transmitter 98. These assembled electronic components 40 are anchored and suspended within the inner cavity 22 within the lower portion 26 of the casing 20, FIGS. 3 and 4.

As previously stated, the microprocessor 55 is preferably the Arduino Uno, which has the potential to perform the functions as previously stated herein. The term Arduino, as defined herein, is an open-source prototyping platform based upon easy-to-use hardware and software, which enable circuitry to read inputs and turn it into an output. These are programmable by the user by sending a set of instructions to the microprocessor 55 on the board by using Arduino language and programming. Use of other boards providing the same or similar function can serve as alternative microprocessors 55 and can be used interchangeably, which is why the present inventor has reference this components by its generic name instead of the more specific term Arduino. Thus, for purposes of this application, microprocessor 55, Arduino and Arduino-compatible are interchangeable by preference to avoid limitations of the subject matter and scope of this component.

Figure 6:
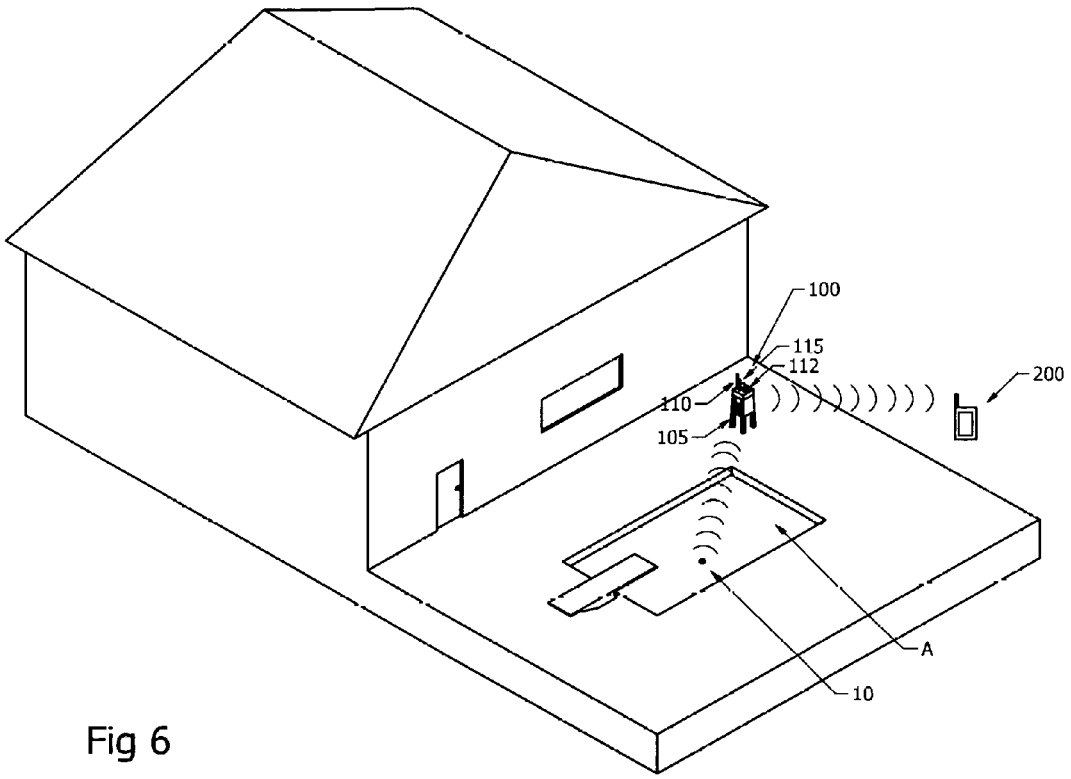
FIG. 6 is a drawing of a swimming pool including the swimming pool monitor

For the variety that produces a wireless remote signal or indication of the presence of a body within the swimming pool A, use of outside secondary alert components 100 would come into play and be part of the inventive subject matter. These secondary alert components 100 include a wireless signal receiver 110 supported by a tower 105, as one example, attaching an alarm indication means 112, such as an audible indicator, a visual indicator or both, and may also include a relay 115 interfacing with a third alert component 200, perhaps a cell phone or in-house receiver, as shown in FIG. 6, by a relay specific software application. This relay 115 may include an assembly of components, by example but without limitation, an XBEE® module which produces the wireless communication sensor or receiver, an XBEE® shield which adapts Arduino to XBEE® language, and XBEE® stick which makes the XBEE® module USB a compatible wireless module. Use of this third alert components 200 may also include the wireless signal receiver 110 having the relay 115 directed to an in-house receiver activating, not shown, the alarm indication means 112, a portable hand-held unit or communication with the cell phone by text, e-mail or live feed camera.

It has been found that the best connection of the lid 30 and the access opening 25 of the casing 20 is a secured or threaded water-tight engagement where the casing 20 and lid 30 are made of a rigid material. It is also contemplated that the casing 20 may be presented without a lid 30 and that all the electronic components 40 and low voltage power supply 50 be sealed within. In this case, the low voltage power supply 50 would require a rechargeable means, either on the casing or a plug which allows the pool monitor device to be plugged in or recharged by other means. One contemplated rechargeable means which is on board the monitor would be the inclusion of solar cells 32 on the upper portion 24 of the sealed casing 20 which provide a perpetual recharging source for the low voltage power supply 50. Inclusion of these solar cells 32 is demonstrated in FIG. 1 of the drawings. This "non-lid" version would be most preferable in the event the casing 20 is not a hard plastic or composition material, but instead a soft foam material which is both buoyant and water-proof. It is also contemplated that to preserve orientation of the swimming pool monitor 10 with the upper portion 24 up and the lower portion down 26, ensuring constant water contact with the electrode 60, that a ballast 23 be included in the inner cavity 22 within the lower portion 26, FIG. 3. This ballast 23 may be a plate, a pouch of material or even the low voltage power supply and electronic circuitry 50 if it is heavy enough to maintain the "upright" position of the swimming pool monitor 10.

While the swimming pool monitor 10 has been particularly shown and described with reference to a preferred embodiment thereof, it will be understood by those skilled in the art that changes in form and detail may be made therein without departing from the spirit and scope of the invention. Thus, the shape, configuration of the electronic components 40 may be substituted, omitted or added to, provided these changes do not affect the function of the disclosed swimming pool monitor 10, especially in the ever changing field of electronics, computer hardware and communication hardware. It is especially important to note that the shapes and drawings do not represent a limitation of the scope of the swimming pool monitor 10 nor are they required to be exact duplicates of the supplied drawings or verbal definitions.

What is claimed is:

1. A free-floating swimming pool monitor to monitor the presence of a person in a swimming pool when the pool is unattended, said swimming pool monitor comprising:

a casing made of a buoyant and water-proof material, said casing defining an inner cavity, an upper portion having an access opening with a removable water-proof lid, and a lower portion having a lower surface defining an electrode groove and an electrode port;

electronic circuitry, including an internal power supply, a microprocessor, an Inertial Measurement Unit (IMU), and an electrode extending an outer portion through said electrode port and engaging said electrode groove in said lower portion of said casing, said electronic circuitry integrating to enable said swimming pool monitor to sense and detect the presence of a person in the swimming pool by motion and by microelectronic deviations measured by the electronic circuitry and activating at least one alarm means, wherein said microprocessor is an Arduino or substantial equivalent, which is defined as an open-source prototyping platform based upon easy-to-use hardware and software, which enable circuitry to read inputs and turn it into an output and are programmable by a user by sending a set of instructions to said microprocessor using Arduino language or a substantial equivalent and programming attaching said electrode, said electrode allowing said microprocessor to record the voltage of the water within said swimming pool over a range of alternating current frequencies and further graphed with respect to frequency at a very minute deviation of current which are then analyzed by said microprocessor to determine whether a grounded body is making contact with the water and pool surfaces, and whether or not the body is more likely a human or some other conductive material in a constantly repeating loop in microseconds;

a low voltage power supply is a rechargeable battery of less than 27 volts; and said electronic circuitry includes a wireless transmitter which transmits a wireless signal to secondary alert components or alarm system.

2. The swimming pool monitor as described in claim 1, further comprising:

said electronic circuitry including but not limited to said microprocessor, supporting resistors, a coil or inductor, diodes, capacitors, wire, a solderable beadboard, an audible emitting means for producing an audible sound, said low voltage power supply, said Inertial Measurement Unit (IMU), which may be presented as an accelerometer or gyroscope sensor, and an optional wireless transmitter, said assembled electronic circuitry anchored and suspended within said inner cavity within said lower portion of said casing.

3. The swimming pool monitor as described in claim 1, further comprising:

said Inertial Measurement Unit (IMU) is supplied as an accelerometer or gyroscope sensor, which records and processes information related to the motion of said swimming pool monitor in said swimming pool, said IMU programmed with said microprocessor to determine turbulence in the wave activity to separate wind movement from a disruptive entry into the water, this distinction being drawn due to the difference in condition of the wave movement, wherein most generally, wind activity causes a gradual change in wave activity that is sustained for a period of time, and abrupt entry causing a more abrupt and less sustained wave activity.

4. The swimming pool monitor as described in claim 1, further comprising:

said electronic circuitry includes a wireless transmitter which transmits a wireless signal to secondary alert components, said secondary alert components including a wireless signal receiver attaching an alarm indication means, including an audible indicator, a visual indicator or both; and a relay interfacing with a third alert component, including a cell phone through text, e-mail or live feed or a unit inside a house by a relay specific software application.

5. The swimming pool monitor as described in claim 1, further comprising:

said casing provides a permanently sealed lid containing said electronic components and a low voltage power supply sealed within; and said low voltage power supply further having an inclusion of solar cells on said upper portion of said casing, providing a perpetual recharging source for said low voltage power supply.

6. The swimming pool monitor as described in claim 1, further comprising a ballast to preserve orientation of said swimming pool monitor with said upper portion up and said lower portion down, ensuring constant water contact with said outer portion of said electrode, said ballast located within said inner cavity in said lower portion.

7. The swimming pool monitor as described in claim 1, further comprising:

a low voltage power supply is a rechargeable battery of less than 27 volts;

said electronic circuitry includes a wireless transmitter which transmits a wireless signal to secondary alert components or alarm system;

said Inertial Measurement Unit (IMU) is supplied as an accelerometer or gyroscope sensor, which records and processes information related to the motion of said swimming pool monitor in said swimming pool, said IMU programmed with said microprocessor to determine turbulence in the wave activity to separate wind movement from a disruptive entry into the water, this distinction being drawn due to the difference in condition of the wave movement, wherein most generally, wind activity causes a gradual change in wave activity that is sustained for a period of time, and abrupt entry causing a more abrupt and less sustained wave activity;

a wireless transmitter which transmits provides a wireless signal to secondary alert components, said secondary alert components including a wireless signal receiver attaching an alarm indication means, including an audible indicator, a visual indicator or both;

a relay interfacing with a third alert component, including a cell phone through text, e-mail or live feed or a unit inside a house by a relay specific software application; and a ballast to preserve orientation of said swimming pool monitor with said upper portion up and said lower portion down, ensuring constant water contact with said outer portion of said electrode, said ballast located within said inner cavity in said lower portion.

* * * * *